US010294826B2

(12) United States Patent
Bandhauer et al.

(10) Patent No.: US 10,294,826 B2
(45) Date of Patent: May 21, 2019

(54) ULTRA EFFICIENT TURBO-COMPRESSION COOLING

(71) Applicant: Colorado State University Research Foundation, Fort Collins, CO (US)

(72) Inventors: Todd M. Bandhauer, Fort Collins, CO (US); Torben P. Grumstrup, Fort Collins, CO (US)

(73) Assignee: Colorado State University Research Foundation, Fort Collins, CO (US)

( * ) Notice: Subject to any disclaimer, the term of this patent is extended or adjusted under 35 U.S.C. 154(b) by 106 days.

(21) Appl. No.: 15/234,824

(22) Filed: Aug. 11, 2016

(65) Prior Publication Data

US 2017/0045272 A1 Feb. 16, 2017

Related U.S. Application Data

(60) Provisional application No. 62/204,326, filed on Aug. 12, 2015.

(51) Int. Cl.

| | |
|---|---|
| ***F01K 25/08*** | (2006.01) |
| ***F25B 27/00*** | (2006.01) |
| ***F01K 11/02*** | (2006.01) |
| ***F01K 7/16*** | (2006.01) |
| *F25B 9/00* | (2006.01) |
| *F25B 25/00* | (2006.01) |

(52) U.S. Cl.

CPC ..... *F01K 25/08* (2013.01); *F01K 7/16* (2013.01); *F01K 11/02* (2013.01); *F25B 27/00* (2013.01); *F25B 9/008* (2013.01); *F25B 25/005* (2013.01); *F25B 2309/061* (2013.01); *F25B 2327/00* (2013.01)

(58) Field of Classification Search

CPC . F01K 25/08; F01K 11/02; F01K 7/16; F25B 27/00; F25B 2327/00; F25B 2309/061; F25B 9/008; F25B 25/005

USPC ..... 60/614, 616, 618; 417/352–356

See application file for complete search history.

(56) References Cited

U.S. PATENT DOCUMENTS 3,259,176 A * 7/1966 Rice ..... F24F 5/00 165/265
4,342,200 A * 8/1982 Lowi, Jr. ..... B60H 1/00007 417/191
4,361,015 A * 11/1982 Apte ..... F25B 27/00 62/238.4

(Continued)

*Primary Examiner* — Hoang M Nguyen
(74) *Attorney, Agent, or Firm* — Polsinelli PC

(57) ABSTRACT

A turbo-compression cooling system includes a power cycle and a cooling cycle coupled one to the other. The power cycle implements a waste heat waste heat exchanger configured to evaporate a first working fluid and a turbine configured to receive the evaporated working fluid. The turbine is configured to rotate as the first working fluid expands to a lower pressure. A condenser condenses the first working fluid to a saturated liquid and a pump pumps the saturated liquid to the waste heat waste heat exchanger. The cooling cycle implements a compressor increasing the pressure of a second working fluid, a condenser condensing the second working fluid to a saturated liquid upon exiting the compressor, an expansion valve expanding the second working fluid to a lower pressure, and an evaporator rejecting heat from a circulating fluid to the second working fluid, thereby cooling the circulating fluid.

23 Claims, 7 Drawing Sheets

(56) References Cited

U.S. PATENT DOCUMENTS

| | | | | | |
|---|---|---|---|---|---|
| 5,136,854 | A * | 8/1992 | Abdelmalek | B01D 53/002 | 60/651 |
| 5,214,932 | A * | 6/1993 | Abdelmalek | B01D 53/002 | 60/651 |
| 5,327,987 | A * | 7/1994 | Abdelmalek | B60K 6/24 | 180/65.25 |
| 5,336,059 | A * | 8/1994 | Rowley | F01K 25/08 | 417/348 |
| 5,351,487 | A * | 10/1994 | Abdelmalek | B60K 6/24 | 60/618 |
| 5,467,713 | A * | 11/1995 | Roosmann | F42C 9/142 | 102/231 |
| 6,349,551 | B1 * | 2/2002 | Jirnov | F25B 9/006 | 62/467 |
| 6,935,129 | B2 * | 8/2005 | Sasaki | B60H 1/00328 | 60/618 |
| 7,454,910 | B2 * | 11/2008 | Hamada | F01K 23/065 | 60/618 |

* cited by examiner

ULTRA EFFICIENT TURBO-COMPRESSION COOLING

CROSS REFERENCE TO RELATED APPLICATION

The present application claims priority to U.S. Provisional Patent Application 62/204,326, filed on Aug. 12, 2015, the contents of which are hereby incorporated by reference.

FIELD

The subject matter herein generally relates to turbo-compression cooling. More specifically, the subject matter herein relates to a system implementing a turbine coupled with a compressor to utilize low-grade waste heat to power a cooling cycle configured to cool a power generation plant.

BACKGROUND

Power generation systems, such as Natural Gas Combined-Cycle (NGCC) power plants, generate a high temperature exhaust used to heat a working fluid. A condenser is used to reject heat to the environment using water from nearby sources in evaporative cooling towers. While the condenser increases the thermal efficiency of the power plant, the condenser also burdens the environment with excess water usage.

SUMMARY

A turbo-compression cooling system includes a power cycle and a cooling cycle coupled one to the other. The power cycle implementing a waste heat waste heat exchanger configured to evaporate a first working fluid and a turbine configured to receive the evaporated working fluid. The turbine having a plurality of vanes disposed around a central shaft and configured to rotate as the first working fluid expands to a lower pressure within the turbine. A condenser then condenses the first working fluid to a saturated liquid and a mechanical pump pumps the saturated liquid to reenter the waste heat waste heat exchanger. The cooling cycle implements a compressor configured to increase the pressure of a second working fluid, a condenser configured to condense the second working fluid to a saturated liquid upon exiting the compressor, an expansion valve wherein the second working fluid expands to a lower pressure, and an evaporator rejecting heat from a circulating fluid to the second working fluid, thereby cooling the circulating fluid. The turbine and compressor can be coupled one to the other, thereby coupling the power cycle and the cooling cycle.

In some instances, the first working fluid and the second working fluid can be the same fluid. In other instances, the first working fluid is a thermal fluid and the second working fluid is a cooling fluid. The thermal fluid is optimized for use in a power cycle and the cooling fluid is optimized for use in a cooling cycle. The thermal fluid can be subcritical fluid (e.g., 1-methoxyheptafluoropropane (HFE-7000) or octafluorocyclobutane (RC318)) or a supercritical fluid (e.g., octafluoropropane (R218)) and the cooling fluid can be a subcritical fluid (e.g., 1,1-Difluoroethane (R-152a)) or a supercritical fluid (e.g., ethane or carbon dioxide). The first and second working fluids can be refrigerants, hydrocarbons, inorganic fluids, and/or any combination thereof.

The power cycle and the first working fluid can be hermetically sealed from the cooling cycle and the second working fluid. The turbine and the compressor can be magnetically coupled one to the other. The magnetic coupling can be achieved by a synchronous magnetic coupling. The turbine can have a first shaft and the compressor can have a second shaft. One of the first shaft and the second shaft can be disposed around at least a portion of the other of the first and second shaft. The first shaft having one or more first polarity magnetic elements and the second shaft having one or more second polarity magnetic elements, the first polarity being opposite from the second polarity and magnetically engaged with one another.

A method of turbo-compression cooling includes receiving, from a power generation system, heat waste in a waste heat waste heat exchanger and evaporating a first working fluid using the heat waste in the waste heat waste heat exchanger, thereby generating mechanical power through expansion of the first working fluid to a lower pressure in a turbine. The expansion of the first working fluid within the turbine rotates the one or more turbine vanes and condenses the first working fluid to a saturated liquid in a condenser. The saturated liquid is pressurized through a mechanical pump to re-enter the waste heat waste heat exchanger. The generated mechanical power is transferred to a compressor. The compressor is configured to receive a second working fluid and compress the second working fluid to increase the pressure. The second working fluid is then condensed in a condenser to a saturated liquid and expanded to a lower pressure in an expansion valve. A circulating cooling fluid rejects heat through an evaporator to the second working fluid. In some instances the evaporator can be a liquid coupled evaporator configured to reject heat to a liquid. In other instances, the evaporator can reject heat to air or another phase change fluid.

In some instances, the first working fluid and the second working fluid can be the same fluid.

In other instances, the first working fluid is a thermal fluid and the second working fluid is a cooling fluid. The thermal fluid is optimized for use in a power cycle and the cooling fluid is optimized for use in a cooling cycle. The thermal fluid can be subcritical fluid (e.g., 1-methoxyheptafluoropropane (HFE-7000) or octafluorocyclobutane (RC318)) or a supercritical fluid (e.g., octafluoropropane (R218)) and the cooling fluid can be a subcritical fluid (e.g., 1,1-Difluoroethane (R-152a)) or a supercritical fluid (e.g., ethane or carbon dioxide). Other combinations of the first working fluid and the second working fluid can include, but are not limited to, HFE-7100/R245fa; HFE-7000/R152a; RC318/R152a, and R218/R152a. (First working fluid/second working fluid).

The method can also include a recuperator configured to reject heat from the first working fluid exiting the turbine, and absorbing heat in the first working fluid exiting the mechanical pump.

BRIEF DESCRIPTION OF THE DRAWINGS

Implementations of the present technology will now be described, by way of example only, with reference to the attached figures, wherein.

DETAILED DESCRIPTION

Figure 1:
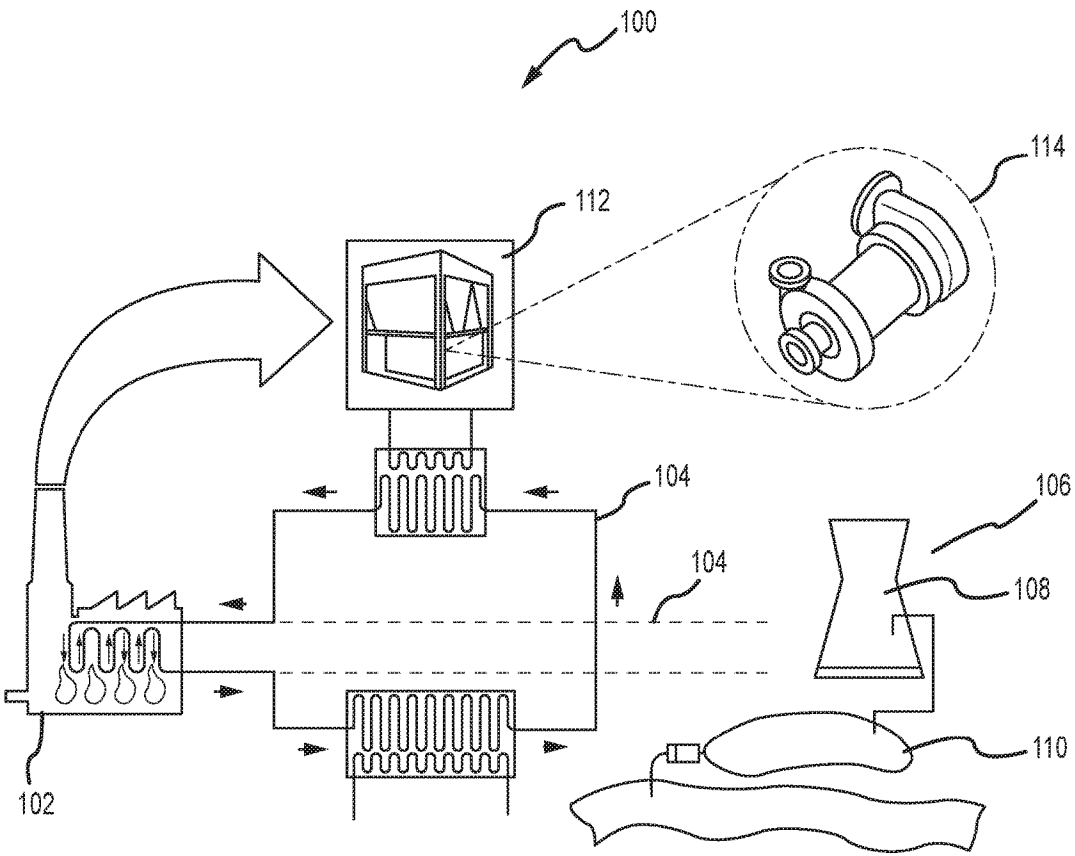
FIG. 1 is an environmental view of a power generation plant implementing turbo-compression cooling in accordance with the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

A "power generation system" is defined as any power generating device, apparatus or system including, but not limited, to power plants, turbines, diesel engines, or other combustion engines.

A "thermal fluid" is defined as any working fluid optimized for use in a power/heating cycle. A "cooling fluid" is defined as any working fluid optimized for use in a cooling/refrigeration cycle. In some instances, a thermal fluid and cooling fluid can be the same, such as water which can operate both a power cycle and cooling cycle.

The present disclosure relates to a system for turbo-compression cooling system including a power cycle and a cooling cycle coupled one to the other. The power cycle implementing a waste heat exchanger configured to evaporate or superheat a first working fluid and a turbine configured to receive the evaporated or superheated working fluid. The turbine having a plurality of vanes disposed around a central shaft and configured to rotate as the first working fluid expands to a lower pressure within the turbine. A condenser then condenses the first working fluid to a saturated or subcooled liquid and a mechanical pump pumps the saturated or subcooled liquid to reenter the waste heat waste heat exchanger. The cooling cycle implementing a compressor configured to increase the pressure of a second working fluid, a condenser configured to condense the second working fluid to a saturated or subcooled liquid upon exiting the compressor, an expansion valve wherein the second working fluid expands to a lower pressure, and an evaporator rejecting heat from a circulating fluid to the second working fluid, thereby cooling the circulating fluid. The turbine and compressor can be coupled one to the other, thereby coupling the power cycle and the cooling cycle.

While the present disclosure is described with respect to a power generation system, it is within the scope of this disclosure to implement the turbo-compression cooling within other systems, such as cooling inlet air on a gas turbine or turbocharged engine, thereby increasing efficiency on hot ambients.

FIG. 1 illustrates a power generation system 100. The power generation system 100 includes a power plant 102. The power plant 102 can be a natural gas combined-cycle (NGCC) power plant exhausting high temperature from a natural gas turbine. A cooling system 104 can be implemented with the power plant 102 to increase the overall efficiency. The cooling system 104 can have an evaporative cooling system 106 using cooling towers 108 and cooling ponds 110 or other nearby water sources. Heat waste from the power plant 102 is rejected into the water causing evaporation and dissipation of water into the atmosphere. The evaporative cooling system 106 increases the net efficiency of the power plant 102, but requires large quantities of water reducing the availability of water for other critical functions, such as crop irrigation.

The cooling system 104 can be an ultra-efficient turbo-compressor cooling system 112 eliminating the need for cooling ponds 110 and large quantities of water, thereby reducing environmental impact while increasing the power plant 102 efficiency. The ultra-efficient turbo-compressor cooling system 112 can include a turbo-compressor 114 efficiently and hermetically coupling two distinct cycles. The supplemental cooling system 112 can achieve a coefficient of performance (COP) of 2.1 or greater. The COP is a ratio of cooling provided to work and heat required.

Figure 2:
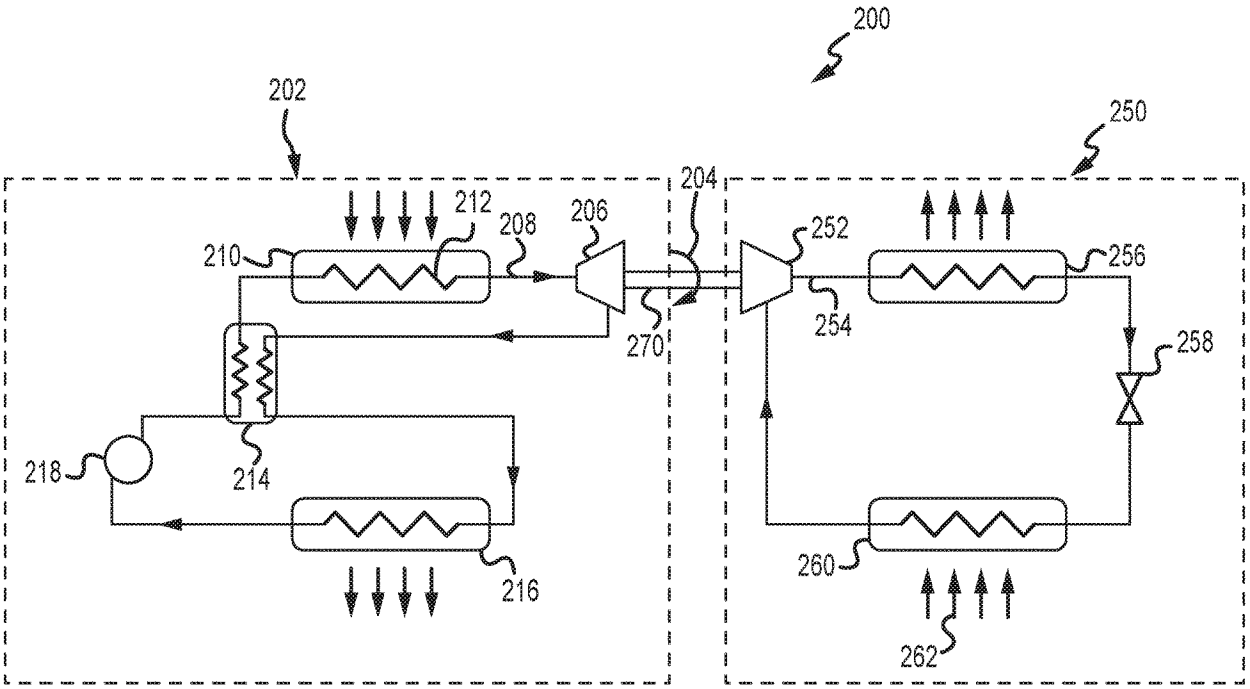
FIG. 2 is a diagrammatic view of a cooling system implementing a turbo-compressor in accordance with the present disclosure.

FIG. 2 illustrates an ultra-efficient turbo-compressor cooling system 200. The ultra-efficient turbo-compressor cooling system 200 can be implemented within the power generation system 100 as an ultra-efficient turbo-compressor cooling system 112. The ultra-efficient turbo-compressor cooling system 200 can have a power cycle 202 and a cooling cycle 250 coupled together by a turbo-compressor 204. The turbo-compressor 204 can be a turbine 206 and a compressor 252 coupled together, as will be discussed in more detail below.

The power cycle 202 operates with a first working fluid 208 receiving waste heat from a power plant, such as the power plant of FIG. 1. A waste heat exchanger 210 can have a heat exchanger 212 configured to reject waste heat from the power plant to the first working fluid 208. The waste heat exchanger 210 can receive a power plant exhaust at a first temperature and pass the power plant exhaust through the heat exchanger 212 within the waste heat exchanger 210 before exiting the waste heat exchanger 210 at a second temperature, lower than the first temperature. The heat exchanger 212 utilizes the waste heat from the power plant working fluid to evaporate or superheat the first working fluid 208 in the waste heat exchanger 210. The first working fluid 208 exits the waste heat exchanger 210 as a vapor and enters the turbine 206. In some instances, the waste heat exchanger 210 can be a waste heat boiler.

The turbine 206 can have a plurality of vanes (shown in FIG. 5) coupled with to a shaft 270, the plurality of vanes configured to impart rotation upon the shaft as the first working fluid 208 expands within the turbine 206. The gaseous first working fluid 208 exiting the waste heat exchanger 208 enters the turbine 206. Expansion of the first working fluid 208 within the turbine 206 generates mechanical power, thus rotating the shaft 270.

In some instances, the turbine 206 can be a multi-stage turbine having a plurality of vanes arranged to allow expansion of the first working fluid 208 and a second plurality of vanes arranged to allow further expansion of the first working fluid 208. The plurality of vanes and the plurality of second vanes are arranged for optimal performance based on the operating pressures, temperatures, and first working fluid 208 of the power cycle 202 of the ultra-efficient turbo-compressor cooling system 200.

The first working fluid 208 can enter a recuperator 214. The recuperator 214 can have two passages for the first working fluid 208, a first passage for rejecting heat and a second passage for receiving heat. The first passage can reject heat from the first working fluid 208 exiting the turbine 206, while the second passage can receive heat into the first working fluid 208 prior reentering the waste heat exchanger 210. The recuperator 214 can be implemented to increase the efficiency of the ultra-efficient turbo-compressor cooling system 200 by preheating the first working fluid 208 prior to reentering the waste heat exchanger 210.

Upon exiting the recuperator 214, the first working fluid enters a dry air condenser 216. The dry air condenser 216 condenses the first working fluid 208 from a vapor to a saturated liquid. The dry air condenser 216 can be an air cooled heat changer allowing the first working fluid 208 to reject heat to the environment. The first working fluid 208 leaves the dry air condenser 216 as a saturated or subcooled liquid and enters a mechanical pump 218. While a dry air condenser 216 is illustrated with respect to the present embodiment, the condenser can also be liquid cooled. For example, the condenser can be coupled to recirculating water, such as seawater into a ship.

The mechanical pump 218 re-pressurizes the first working fluid 208 and circulates the working fluid 208 to the second passage of the recuperator 214. As the first working fluid 208 passes through the second passage of the recuperator 214 it receives heat rejected from the first working fluid 208 passing through the first passage of the recuperator 214. The first working fluid 208 passing through the second passage of the recuperator 214 preheats the first working fluid prior to reentry into the waste heat exchanger 210. The recuperator 214 heats the first working fluid 208 to just below the evaporator saturation temperature. The preheating of the first working fluid 208 improves the overall efficiency of the power cycle 200 by utilizing less heat waste from the waste heat exchanger 210 to warm the first working fluid 208 to its saturation temperature. Preheating the first working fluid 208 in the recuperator 214 allows the power plant heat waste received into waste heat exchanger 210 to be used more efficiently.

While the ultra-efficient turbo-compressor cooling system 200 is shown and described with respect to the power cycle 202 having a recuperator 214, the power cycle 202 can alternatively be implemented with the recuperator 214 removed. The recuperator 214 can be omitted for power cycles involving working fluids with specific properties that mitigate the efficiency gain provided by the recuperator 214.

The cooling cycle 250 operates with a second working fluid 254. The cooling cycle 250 operates by the compressor 252 receiving the mechanical work generated by the turbine 206 as described above. The second working fluid 254 enters the compressor as a saturated vapor, and the compressor 252 raises the pressure of the second working fluid 254. The second working fluid 254 moves from the compressor 252 to a dry air condenser 256.

In some instances, the compressor 252 can be a multi-stage compressor having a plurality of impeller arranged to allow compression of the second working fluid 254 and a second plurality of impellers arranged to allow further expansion of the second working fluid 254. The plurality of impellers and the plurality of second impellers are arranged for optimal performance based on the operating pressures, temperatures, and second working fluid 208 of the cooling cycle 250 of the ultra-efficient turbo-compressor cooling system 200.

The dry air condenser 256 is an air-cooled heat exchanger condensing the second working fluid 254 from a slightly superheated vapor to a saturated or subcooled liquid. The dry air condenser 256 can have a forced air flow across the heat exchanger to increase efficiency and cooling of the second working fluid. The second working fluid 254 exits the dry air condenser 256 and enters an expansion valve 258.

The expansion valve 258 can operate as a flow control device within the cooling cycle 250. The expansion valve 258 controls the amount of the second working fluid 254 flowing from the condenser 256 to an evaporator 260. The high-pressure liquid second working fluid 254 exiting the condenser 256 enters the expansion valve 258 which allows a portion of the second working fluid 254 to enter the evaporator 260. The expansion valve 258 allows a pressure drop in the second working fluid 254, thus expanding to a lower pressure prior to entering the evaporator 260.

The expansion valve 258 can have a temperature sensing bulb filled with a gas similar to the second working fluid 254. The expansion valve 258 opens as the temperature on the bulb increases from the second working fluid 254 exiting the dry air condenser 256. The change in temperature creates a change in pressure on a diaphragm and opens the expansion valve 258. The diaphragm can be biased to a closed position by a biasing element, such as a spring or actuator, and the change in pressure on the diaphragm and causes the biasing element to move the expansion valve 258 to an open position.

The evaporator 260 receives the second working fluid 254 from the expansion valve 258 and allows expansion to a gaseous phase. The evaporator 260 passes the second working fluid 254 through to absorb heat from a circulating cooling fluid 262, thereby generating the desired cooling effect by reducing the temperature of the circulating cooling fluid 262. The expansion valve 258 is used to limit flow of the second working fluid 254 into the evaporator 260 to keep pressure low and allow expansion of the second working fluid 254 into a gaseous state.

The evaporator can receive the circulating cooling fluid 262 at a first predetermined temperature and discharge the circulating cooling fluid 262 at a second predetermined temperature. The second predetermined temperature being lower than the first predetermined temperature. The temperature change occurs as a result of the second working fluid 254 absorbing heat from the circulating cooling fluid 262.

The first working fluid 208 and the second working fluid 254 can be hermetically sealed one from the other within the turbo-compressor 204. The first working fluid can be a thermal fluid optimized for use in the power cycle 202. Representative thermal fluids can include refrigerants, hydrocarbons, inorganic fluids, and/or any combination thereof, which can be operate in the subcritical two-phase region or the supercritical region depending on the waste heat temperature and fluid flow rate and the desired trade-off between compactness and COP. Example subcritical fluids can include refrigerants 1-methoxyheptafluoropropane (HFE-7000), methoxy-nonafluorobutane (HFE-7100), or octafluorocyclobutane (RC318), hydrocarbon propane, or inorganic water or ammonia. Example supercritical fluids include refrigerants octafluoropropane (R218) and carbon dioxide, hydrocarbon ethane, and inorganic xenon.

The second working fluid 254 can be a cooling fluid optimized for use in the cooling cycle 250. Representative cooling fluids can include refrigerants, hydrocarbons, inorganic fluids, and/or any combination thereof, which can be operate in the subcritical two-phase region or the supercritical region depending on the waste heat temperature and fluid flow rate and the desired trade-off between compactness and COP. Example subcritical fluids can include refrigerants 1,1-Difluoroethane (R-152a), pentafluoropropane (R-245fa), 1,1,1,2-Tetrafluoroethane (R-134a), hydrocarbon propane, or inorganic water or ammonia. Example supercritical fluids include refrigerants octafluoropropane (R218) and carbon dioxide, hydrocarbon ethane, and inorganic xenon. While the first working fluid 208 and the second working fluid 254 can be the same fluid, such as water, the ultra-efficient turbo-compressor cooling system 200 can achieve a higher COP utilizing different working fluids.

Proposed combinations of the first working fluid and second working fluid can include, but are not limited to, HFE-7100/R245fa; HFE-7000/R152a; RC318/R152a, and R218/R152a, respectively listed as first working fluid/second working fluid.

Figure 3:
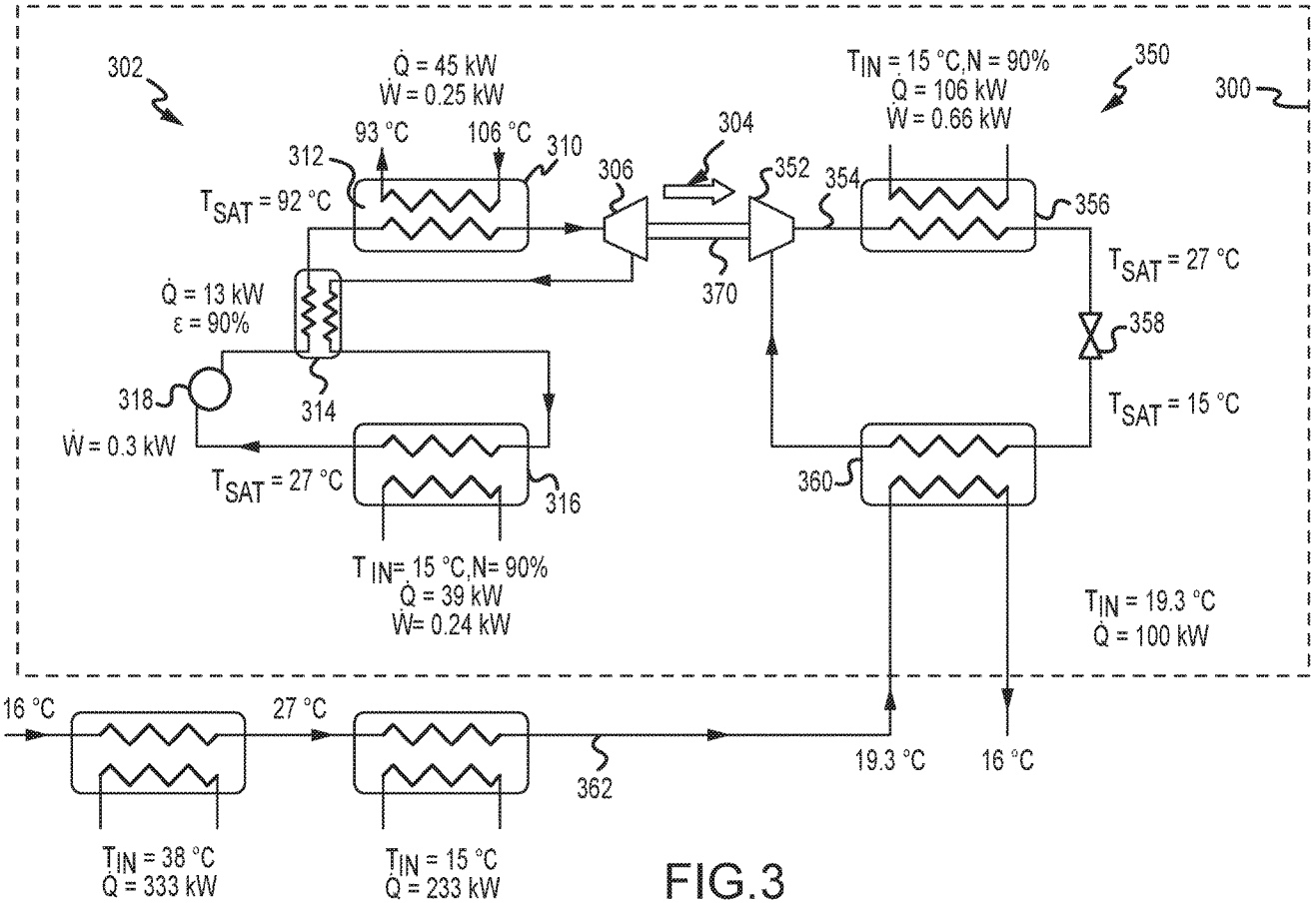
FIG. 3 is a diagrammatic view of an example embodiment of a cooling system implementing a turbo-compressor of FIG. 2.

FIG. 3 illustrates a specific example of an ultra-efficient turbo-compressor cooling system 300 according to the present disclosure. A power cycle 302 and a cooling cycle 350 can be coupled together by a turbo compressor 304. The turbo-compressor 304 can have a turbine 306 and a compressor 352 having a magnetic synchronous coupling. The magnetic synchronous coupling is described in more detail below with respect to FIGS. 6-9. The magnetic synchronous coupling can hermetically seal the power cycle 302 and the cooling cycle 350 allowing the power cycle 302 to implement a first working fluid 308 and the cooling cycle 350 to implement a second working fluid 354. The first working fluid 308 and the second working fluid 354 being different and each optimized for performance in their respective cycle. In the illustrated embodiment, the first working fluid 308 is HFE-7100 and the second working fluid 354 is R245fa.

The power cycle 302 operates with the first working fluid 308 receiving waste heat from a power plant, such as the power plant of FIG. 1. A waste heat exchanger 310 can have a heat exchanger 312 configured to reject waste heat from the power plant to the first working fluid 308. The waste heat exchanger 310 can receive a power plant working fluid at a first temperature and pass the power plant working fluid through the heat exchanger 312 within the waste heat exchanger 310 before exiting the waste heat exchanger 310 at a second temperature, lower than the first temperature. In the illustrated embodiment, the power plant working fluid enters the waste heat exchanger 310 at 106° C. and exits the waste heat exchanger at 93° C. The power plant working fluid rejects 45 kW of heat in the waste heat exchanger 310. The waste heat exchanger 310 can implement a fan or blower requiring 0.25 kW of power. The rejected heat from the power plant working fluid evaporates the first working fluid 308 which exits the waste heat exchanger 310 as a vapor and then enters the turbine 306.

The turbine 306 has a plurality of vanes (shown in FIG. 5), and the plurality of vanes are configured to rotate as the first working fluid 308 expands within the turbine 306. The gaseous first working fluid 308 exiting the waste heat exchanger 310 enters the turbine 306 and expansion of the first working fluid 308 within the turbine 306 generates mechanical power. The turbine 306 has greater than 80% efficiency in generating mechanical power from the expansion of the first working fluid 308. The mechanical power generated can be transferred to the compressor 352 of the turbo-compressor 304 by the magnetic synchronous coupling 370 with greater than 90% efficiency. The magnetic synchronous coupling 370 reduces power loss between the turbine 306 and the compressor 352 while hermetically sealing the power cycle 302 and the cooling cycle 350.

The first working fluid 308 can enter a recuperator 314. The recuperator 314 can be a heat exchanger configured to impart heat transfer from one portion of the first working fluid 308 to a differ portion of the first working fluid 308. The recuperator 214 has two passages for the first working fluid 308, a first passage for rejecting heat and a second passage for absorbing heat. The first passage can reject heat from the first working fluid 308 up exiting the turbine 306, while the second passage can absorb heat into the first working fluid 308 prior reentering the waste heat exchanger 310.

In the illustrated embodiment, the recuperator 314 transfers 13 kW of heat from the first working fluid 308 exiting the turbine 306 to the first working fluid 308 re-entering the waste heat exchanger 310. The recuperator 314 is at least 90% effective in the heat transfer from one portion of the first working fluid 308 to another portion of the first working fluid 308. The ultra-efficient turbo-compressor cooling system 300 implementing HFE-7100 as the first working fluid utilizes the recuperator 314 to increase the efficiency by preheating the first working fluid 308 prior to reentering the waste heat exchanger 310.

Upon exiting the recuperator 314, the first working fluid 308 enters a dry air condenser 316. The dry air condenser 216 condenses the first working fluid 308 from a vapor to a saturated liquid by rejecting heat to the environment. The dry air condenser 316 rejects 39 kW of heat from the first working fluid 308 to the environment when the environment has an ambient temperature of 15° C. The dry air condenser 316, similar to the waste heat exchanger 310, can have a blower or fan requiring 0.24 kW of work input. The first working fluid 308 leaves the dry air condenser 316 as a saturated liquid and enters a mechanical pump 318.

The mechanical pump 318 re-pressurizes the first working fluid 308 and circulates the working fluid 308 to the second passage of the recuperator 314. In the illustrated embodiment, the mechanical pump 318 requires 0.3 kW of work for operation.

The first working fluid 308 passes from the mechanical pump 318 to the second passage of the recuperator 314 and re-enters the waste heat exchanger 310 to repeat the power cycle 302.

The cooling cycle 350 operates with the second working fluid 354. The cooling cycle 350 operates by the compressor 352 receiving the mechanical work generated by the turbine 306 and transferred by the magnetic synchronous coupling 370, as described above. The second working fluid 354 enters the compressor 352 as a saturated vapor, and the compressor 352 raises the pressure of the second working fluid 354. In the illustrated embodiment, the compressor 352 can achieve an 80% or greater efficiency. The second working fluid 354 moves from the compressor 352 to a dry air condenser 356.

The dry air condenser 356 is an air-cooled heat exchanger condensing the second working fluid 354 from a slightly superheated vapor to a saturated or subcooled liquid. In the illustrated embodiment, the dry air condenser 356 can allow the second working fluid 354 to reject 106 kW of heat to the environment. To achieve the heat rejection, the dry air condenser 356 can implement a fan or blower requiring 0.66 kW of work input.

An expansion valve 358 can operate as a flow control device within the cooling cycle 350. The expansion valve 358 controls the amount of the second working fluid 354 flowing from the condenser 356 to an evaporator 360. The high-pressure liquid second working fluid 354 exiting the condenser 356 enters the expansion valve 358 which allows a portion of the second working fluid 354 to enter the evaporator 360. The expansion valve 358 allows a pressure drop in the second working fluid 354, thus expanding to a lower pressure prior to entering the evaporator 360. In the illustrated embodiment, the second working fluid 354 experiences a pressure drop within the expansion valve 358 and a corresponding saturation temperature drop from 27° C. to 15° C., allowing the second working fluid 354 to exit the expansion valve 358 at 15° C.

The evaporator 360 receives the second working fluid 354 from the expansion valve 358 and allows expansion to a gaseous phase. The evaporator 360 is configured to absorb heat from a circulating cooling fluid 362 to the second working fluid 354, thereby generating the desired cooling effect by reducing the temperature of the circulating cooling fluid 362. In the illustrated embodiment, the circulating cooling fluid 362 is water.

In the illustrated embodiment, the evaporator 360 can receive the circulating cooling fluid 362 at a 19.3° C. and discharge the circulating cooling fluid 262 at 16° C. The evaporator 360 allows the second working fluid 354 to absorb 100 kW of heat from the circulating cooling fluid 362.

Figure 4:
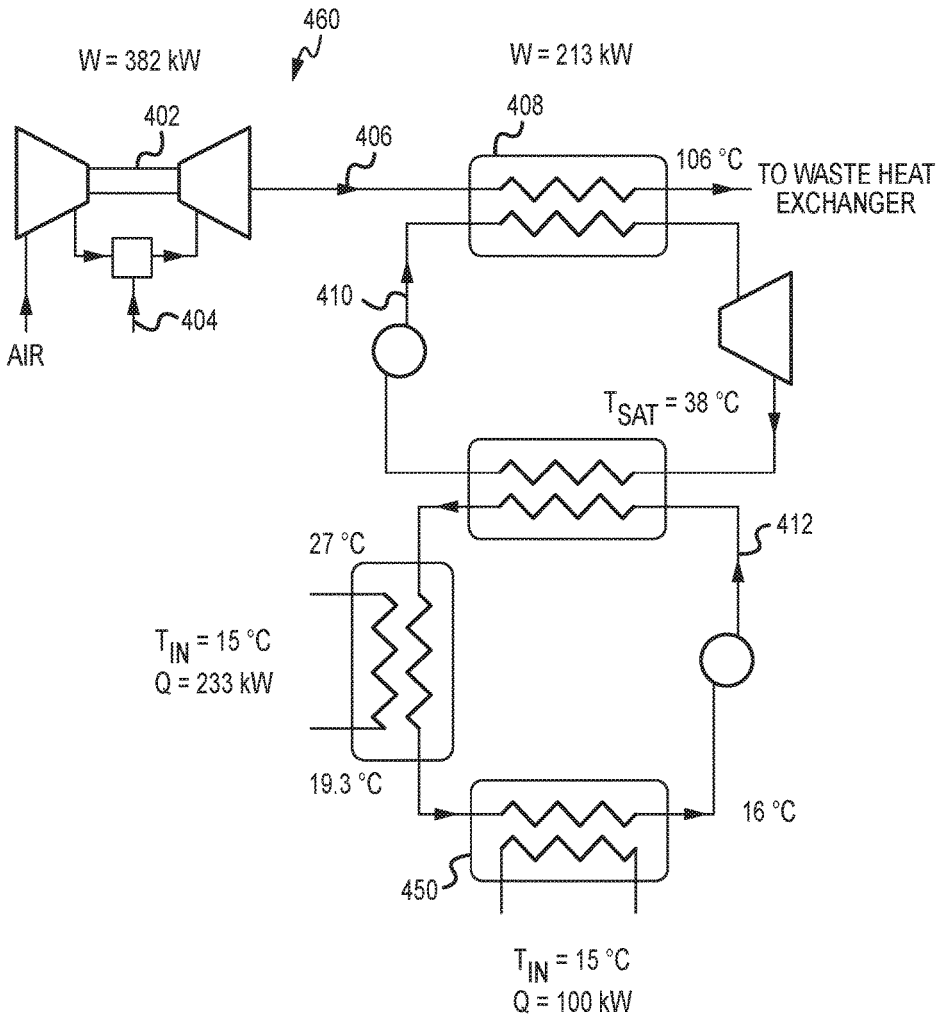
FIG. 4 is a diagrammatic view of a power plant in accordance with the present disclosure.

FIG. 4 illustrates a diagrammatic view of a power generation system 400 and its coupling to a supplemental cooler 450. The power generation system 400 is an example of a power generation system 100 illustrated above with respect to FIG. 1. The power generation system 400 can have a gas turbine 402 receiving, combusting, and burning a fuel 404. The fuel 404 can be natural gas, diesel, oil, or any other combustible material.

The gas turbine heats a power plant working fluid 406 that transfers a portion of its heat to the through a heat exchanger 408 to an energy generation cycle 410. The energy generation cycle 410 can be cooled by a circulated cooling fluid 412, which will separately be cooled by the supplemental cooling system 450 utilizing waste heat from the power generation system 400.

As can be appreciated in FIG. 4, the circulating cooling fluid 412 can absorb heat from the energy generation cycle 410 through a heat exchanger 414 and reject a portion of the heat to the environment through a dry air cooler 416. The supplemental cooler 450 can then absorb heat from the circulating cooling fluid 412. In the illustrated embodiment, the dry air cooler 416 reduces the circulating cooling fluid temperature 412 from 27° C. to 19.3° C., assuming an ambient air temperature of 15° C. while the supplemental cooler 450 reduces the temperature from 19.3° C. to 16° C. The circulating cooling fluid 412 then proceeds back to the heat exchanger 414 to absorb heat from the energy generation cycle 410.

After exiting the heat exchanger 408, the power plant working fluid 406 enters an ultra-efficient turbo-compressor cooling system to reject additional heat. In the illustrated embodiment, the power plant working fluid 406 can exit the heat exchanger at 106° C. and then enter the supplemental cooler 450. The supplemental cooler 450 can operate as described above with respect to FIGS. 2 and 3 utilizing waste heat from the power generation system 400 and gas turbine 402 to cool the circulating cooling fluid 412.

Figure 5:
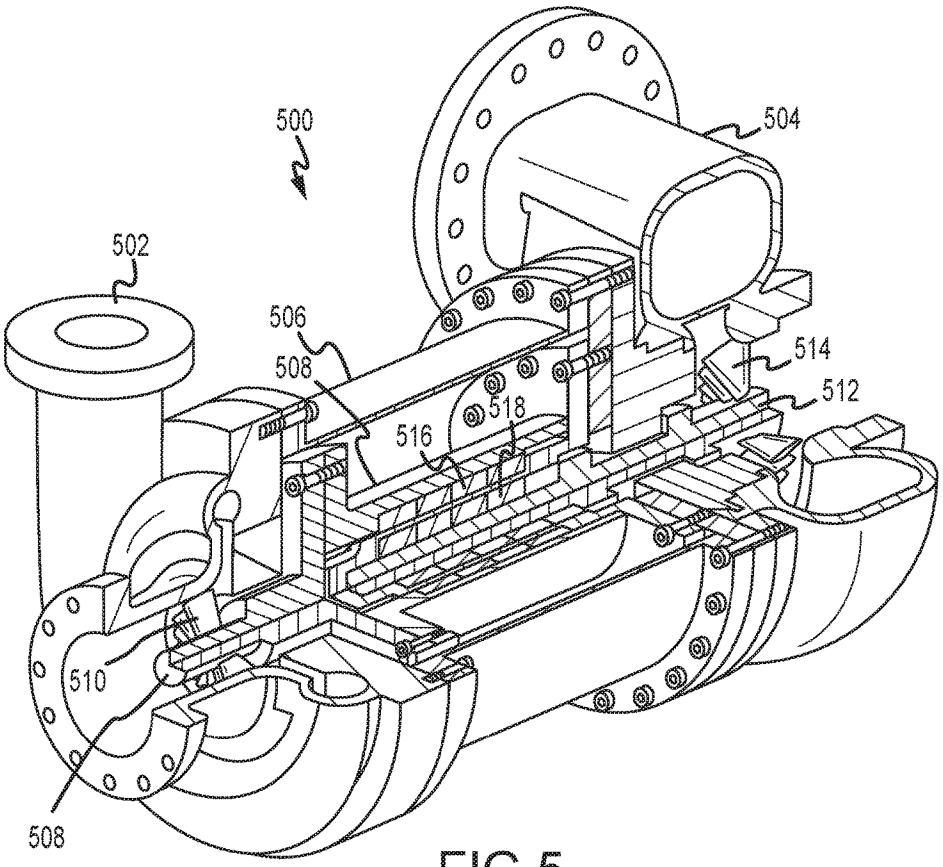
FIG. 5 is a section isometric view of a turbo-compressor having a synchronous magnetic coupling in accordance with the present disclosure.
Figure 6:
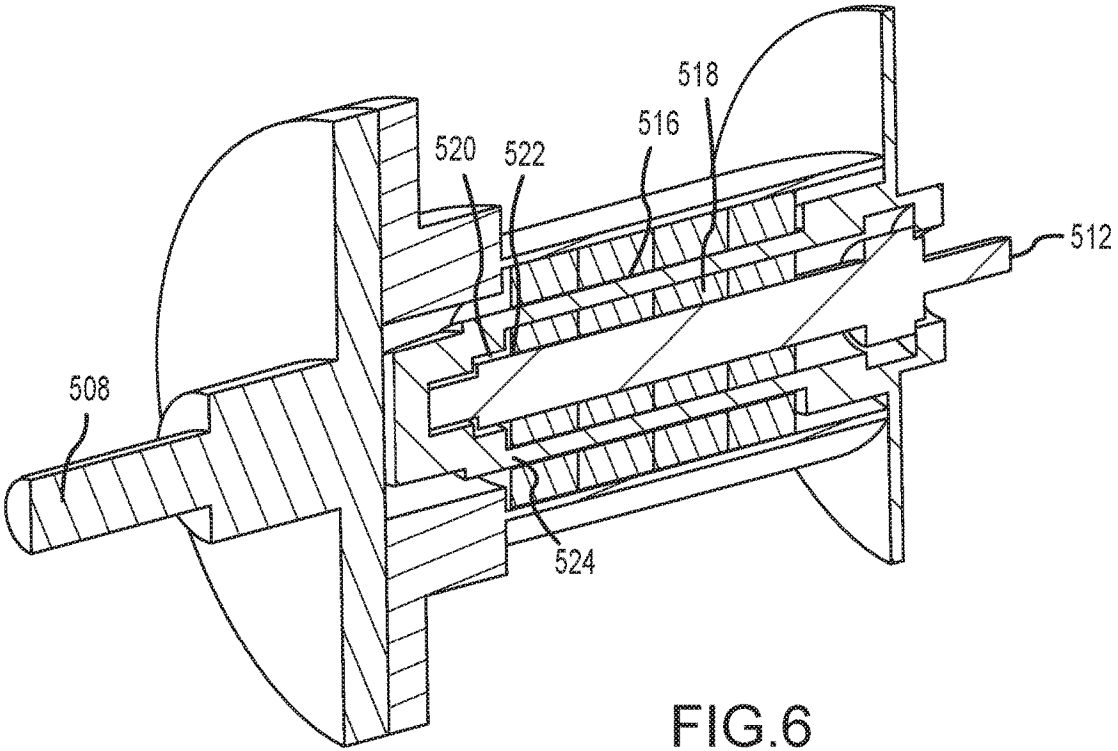
FIG. 6 is a longitudinal cross-section view of a synchronous magnetic coupling in accordance with the present disclosure.
Figure 7:
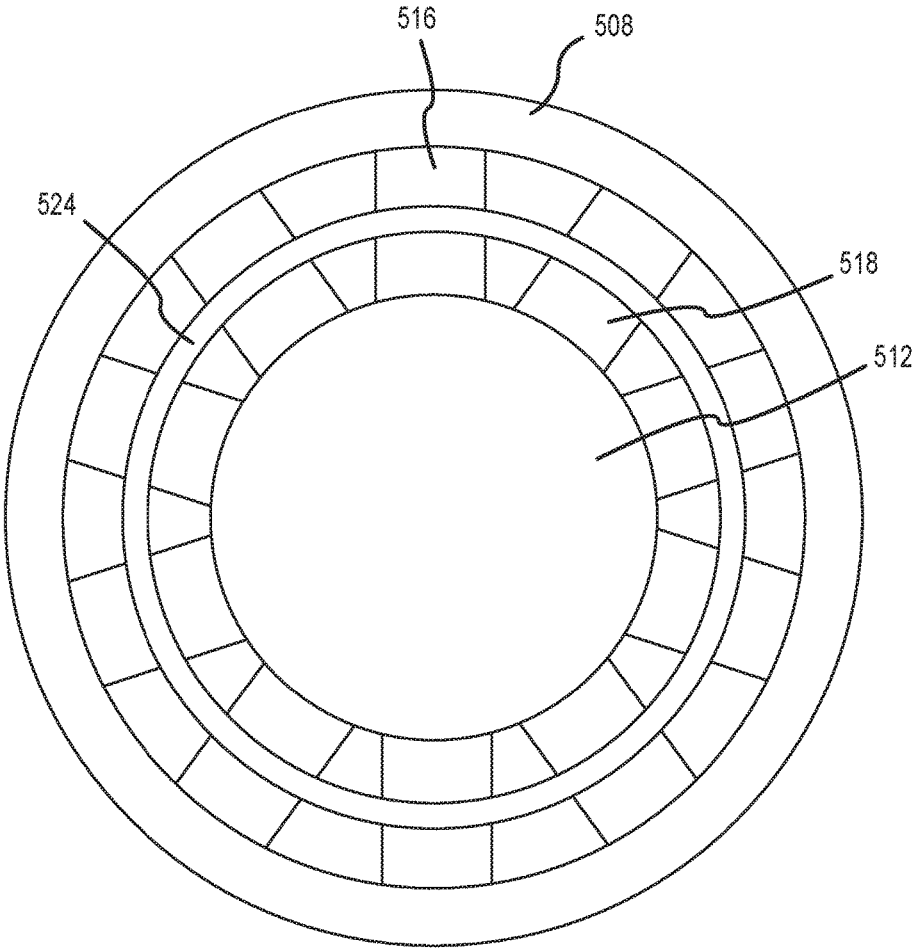
FIG. 7 is an axial cross-section view of a synchronous magnetic coupling in accordance with the present disclosure.

FIG. 5 illustrates an example turbo-compressor having a synchronous magnetic coupling. FIGS. 6 and 7 illustrate an example synchronous magnetic coupling. The turbo-compressor 500 has a turbine 502 and a compressor 504 coupled together by a synchronous magnetic coupling 506. The turbine 502 can have a plurality of vanes 510 coupled to a first shaft 508. The plurality of vanes 510 can impart rotation upon the first shaft 508 as a working fluid expands within the turbine 502.

The compressor 504 can have a plurality of impellers 514 coupled to a second shaft 512. The second shaft 512 is configured to rotate the plurality of impellers 514 thus compressing a working fluid within the compressor 504.

The turbine 502 and the compressor 504 are coupled together by the synchronous magnetic coupling 506. The synchronous magnetic coupling 506 can include the first shaft 508 and the second shaft 512 magnetically engaged with one other, thereby transferring mechanical power generated by the working fluid expansion in the turbine 502 to the compressor 504. The first shaft 508 of the turbine 502 can have one or more first magnetic elements 516 disposed thereon and the second shaft of 512 of the compressor 504 can have one or more second magnetic elements 518 disposed thereon for magnetic engagement with the one or more first magnetic elements 516.

The synchronous magnetic coupling 506 can couple the turbine 502 and 504 such that the first shaft 508 and the second shaft 512 rotate at the same speed. The synchronous magnetic coupling 506 can further be a lubricant free coupling requiring no lubricant within the system. In other instances, the first working fluid or second working fluid can act as a lubricant.

As can be appreciated in FIGS. 5 and 6, the first shaft 508 has a substantially hollow inner portion 520 and is configured to receive at least a portion of the second shaft 512 therein. The hollow inner portion 520 of the first shaft 508 has one or more first magnetic elements 516 coupled thereto. The second shaft 512 has one or more second magnetic elements 518 coupled to an outer surface 522 of the second shaft 512. The one or more first magnetic elements 516 engage with the one or more second magnetic elements 518 such that rotation of the first shaft 508 rotates the second shaft 512.

The one or more first magnetic elements 516 and one or more second magnetic elements 518 can be permanent magnets, electromagnets, or any other material capable of inducing a magnetic coupling therebetween. In at least one embodiment, the one or more first magnetic elements 516 can have a positive polarity and the one or more second magnetic elements 518 can have a second polarity opposite from the first polarity.

The synchronous magnetic coupling 506 can also include a containment shroud 524 disposed between the one or more first magnetic elements 516 and the one or more second magnetic elements 518. The containment shroud 524 can be disposed between the magnetic elements, but configured to allow magnetic engagement between the one or more first magnetic elements 516 and the one or more second magnetic elements 518. The containment shroud 524 is coupled with one of the turbine 502 or the compressor 504 and hermetically seals the turbo-compressor 500 by having a first working fluid associated with the turbine 502 and a second working fluid associated with the compressor 504.

While the synchronous magnetic coupling 506 is described as having the first shaft 508 disposed around at least a portion of the second shaft 512, it is within the scope of the present disclosure to implement the synchronous magnetic coupling 506 with the first shaft 508 at least partially received within the second shaft 512.

In some instances, the turbo-compressor can also implement a rotational shaft seal to achieve hermetic sealing between the turbine 502 and the compressor 504.

It is believed the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiments of the disclosure.

What is claimed is:

1. A system for turbo-compression cooling comprising:

a power cycle comprising:

a first working fluid;

a waste heat exchanger configured to heat the first working fluid to a superheated vapor;

a turbine receiving the superheated vapor working fluid, the turbine having a plurality of vanes disposed around a central shaft and configured to rotate about the central shaft, the plurality of vanes configured to rotate as the working fluid expanding to a lower pressure; and a condenser condensing the working fluid to a subcooled liquid;

a cooling cycle comprising:

a second working fluid;

a compressor configured to increase the pressure of the second working fluid;

a cooler configured to cool the second working fluid after exiting the compressor;

an expansion valve wherein the second working fluid expands to a lower pressure;

an evaporator rejecting heat from a circulating fluid to the second working fluid, thereby cooling the circulating fluid;

wherein the turbine and compressor are magnetically coupled one to the other and hermetically sealed one from the other, thereby coupling and sealing the power cycle and the cooling cycle, and the first working fluid and the second working fluid are optimized such that the turbine and compressor rotate at the same rotational speed and the turbine and the compressor have an isentropic efficiency greater than eighty (80) percent (%).

2. The system of claim 1, wherein the power cycle condenser is a dry air condenser and the cooling cycle cooler is a dry air cooler.

3. The system of claim 1, wherein the first working fluid and the second working fluid are the same fluid.

4. The system of claim 1, wherein the first working fluid is a refrigerant, hydrocarbon, inorganic fluid, or combination thereof and the second working fluid is a refrigerant, hydrocarbon, inorganic fluid, or combination thereof.

5. The system of claim 1, wherein the first working fluid is a supercritical fluid in the waste heat exchanger and the second working fluid is a supercritical fluid in the cooler.

6. The system of claim 1, wherein the first working fluid is a supercritical fluid in waste heat exchanger and the second working fluid is a subcritical fluid throughout the cooling cycle.

7. The system of claim 1, wherein the first working fluid is a subcritical fluid throughout the power cycle and the second working fluid is a subcritical fluid throughout the cooling cycle.

8. The system of claim 1, wherein the first working fluid is one of 1-methoxyheptafluoropropane, methoxy-nonafluorobutane, octafluorocyclobutane, octafluoropropane, carbon dioxide, hydrocarbon ethane, or inorganic xenon and the second working fluid is one of 1,1-Difluoroethane, pentafluoropropane, 1,1,1,2-Tetrafluoroethane, octafluoropropane, carbon dioxide, hydrocarbon ethane, or inorganic xenon.

9. The system of claim 1, wherein the turbine has a first shaft and the compressor has a second shaft, one of the first shaft and the second shaft disposed around at least a portion of the other of the first shaft and the second shaft, the first shaft having one or more first polarity magnetic elements and the second shaft having one or more second polarity magnetic elements, the first polarity and the second polarity being opposite and magnetically engaged with one another.

10. The system of claim 1, wherein the turbine and the compressor are coupled by a common shaft and have a rotational shaft seal hermetically separating the first working fluid and the second working fluid.

11. The system of claim 1, further comprising a recuperator configured to receive heat rejected by the first working fluid, and wherein the recuperator transfers the rejected heat to the subcooled liquid as the working fluid re-enters the waste heat exchanger.

12. The system of claim 1, wherein the turbine is a multi-stage turbine having at least a first stage having a plurality of vanes arranged to allow expansion of the first working fluid to an expanded first working fluid and at least a second stage having a second plurality of vanes arranged to allow expansion of the expanded first working fluid.

13. The system of claim 1, wherein the compressor is a multi-stage compressor having at least a first stage having a plurality of impellers arranged to allow compression of the second working fluid to a compressed second working fluid and at least a second stage having a second plurality of impellers arranged to allow compression of the compressed second working fluid.

14. The system of claim 1, wherein the turbine and compressor coupling is lubricant free.

15. A method of turbo-compression cooling, the method comprising:

receiving, from a power generation system, heat waste in a waste heat exchanger;

heating a first working fluid using the heat waste in the waste heat exchanger to a superheated vapor;

generating mechanical power through expansion of the first working fluid to a lower pressure in a turbine, the expansion of the first working fluid rotating one or more turbine vanes;

condensing the first working fluid to a subcooled liquid in a condenser;

pressurizing the subcooled liquid through a mechanical pump to re-enter the waste heat exchanger;

transferring the generated mechanical power to a compressor, the compressor configured to receive a second working fluid;

compressing the second working fluid thereby increasing the pressure of the second working fluid;

cooling the second working fluid in a cooler;

expanding the second working fluid to a lower pressure in an expansion valve;

rejecting heat through a liquid coupled evaporator from circulating cooling fluid to the second working fluid, wherein the turbine and compressor are magnetically coupled one to the other and hermetically sealed one from the other, thereby coupling and sealing the power cycle and the cooling cycle, and the first working fluid and the second working fluid are optimized such that the turbine and compressor rotate at the same rotational speed and the turbine and the compressor have an isentropic efficiency greater than eighty (80) percent (%).

16. The method of claim 15, wherein the first working fluid condenser is a dry air condenser and the second working fluid cooler is a dry air cooler.

17. The method of claim 15, wherein the first working fluid and the second working fluid are the same fluid.

18. The method of claim 15, further comprising rejecting heat from the first working fluid exiting the turbine in a recuperator, and absorbing heat in the first working fluid exiting the mechanical pump.

19. The method of claim 15, wherein the first working fluid is a refrigerant, hydrocarbon, inorganic fluids, or combination thereof and the second working fluid is a refrigerant, hydrocarbon, inorganic fluid, or combination thereof.

20. The method of claim 15, wherein the first working fluid is a supercritical fluid in the waste heat exchanger and the second working fluid is a supercritical fluid in the cooler.

21. The method of claim 15, wherein the first working fluid is a supercritical fluid in the waste heat exchanger and the second working fluid is a subcritical fluid and is a subcooled liquid in the outlet of the cooler.

22. The system of claim 15, wherein the first working fluid is a subcritical fluid in the waste heat exchanger and the second working fluid is a subcritical fluid in the cooler.

23. The method of claim 15, wherein the first working fluid is one of 1-methoxyheptafluoropropane, methoxy-nonafluorobutane, octafluorocyclobutane, octafluoropropane, carbon dioxide, hydrocarbon ethane, or inorganic xenon and the second working fluid is one of 1,1-Difluoroethane, pentafluoropropane, 1,1,1,2-Tetrafluoroethane, octafluoropropane, carbon dioxide, hydrocarbon ethane, or inorganic xenon.

* * * * *